US008112997B2

(12) United States Patent
Bellows

(10) Patent No.: US 8,112,997 B2
(45) Date of Patent: Feb. 14, 2012

(54) CONDENSATE POLISHER CIRCUIT

(75) Inventor: James C. Bellows, Maitland, FL (US)

(73) Assignee: Siemens Energy, Inc., Orlando, FL (US)

( * ) Notice: Subject to any disclaimer, the term of this patent is extended or adjusted under 35 U.S.C. 154(b) by 455 days.

(21) Appl. No.: 12/366,738

(22) Filed: Feb. 6, 2009

(65) Prior Publication Data

US 2009/0266076 A1 Oct. 29, 2009

Related U.S. Application Data

(60) Provisional application No. 61/048,328, filed on Apr. 28, 2008.

(51) Int. Cl.
*F01K 17/00* (2006.01)

(52) U.S. Cl. ..... 60/686; 60/685

(58) Field of Classification Search ..... 60/685–690
See application file for complete search history.

(56) References Cited

U.S. PATENT DOCUMENTS 3,847,805 A 11/1974 Voedisch
3,976,541 A * 8/1976 Stiteler et al. ..... 376/310
4,251,219 A 2/1981 Larson et al.
4,383,046 A * 5/1983 Emmett ..... 521/26
4,613,952 A * 9/1986 McClanahan ..... 703/6
4,644,479 A 2/1987 Kemper et al.
4,820,421 A 4/1989 Auerswald
4,857,202 A 8/1989 McNulty
5,389,261 A 2/1995 Daly et al.
RE35,741 E 3/1998 Oren et al.
5,746,971 A * 5/1998 Millett et al. ..... 422/16
5,779,814 A 7/1998 Fellers, Sr. et al.
5,873,238 A 2/1999 Bellows
5,904,039 A 5/1999 Bruckner et al.
6,089,013 A 7/2000 Bruckner et al.
6,237,321 B1 5/2001 Schmid et al.
6,343,570 B1 2/2002 Schmid et al.
6,363,711 B2 4/2002 Schmid et al.
6,755,023 B2 6/2004 Koenig et al.
6,823,674 B2 11/2004 Schwarzott
6,872,308 B1 3/2005 Bellows
7,306,653 B2 12/2007 Bellows et al.

* cited by examiner

*Primary Examiner* — Hoang Nguyen

(57) ABSTRACT

A power generating system including a working fluid circuit. The power generating system includes a condenser system in the working fluid circuit and a condensate polisher circuit. The condenser system receives a working fluid that includes steam or a combination of water and steam and condenses at least a portion of the working fluid into a condensate. The condensate has a temperature above a predetermined upper operating temperature. The condensate polisher circuit is branched off from the working fluid circuit and receives and treats said condensate from the working fluid circuit and returns treated condensate to the working fluid circuit. The condensate polisher circuit includes a heat exchanger that reduces the temperature of the condensate at least to the upper operating temperature and a condensate polisher that removes contaminants from the condensate to bring the condensate to a predetermined purity.

20 Claims, 3 Drawing Sheets

CONDENSATE POLISHER CIRCUIT

CROSS-REFERENCE TO RELATED APPLICATION

This application claims the benefit of U.S. Provisional Application Ser. No. 61/048,328, entitled CONDENSATE POLISHERS FOR HIGH TEMPERATURE CONDENSATE, filed Apr. 28, 2008, the entire disclosure of which is incorporated by reference herein.

FIELD OF THE INVENTION

The present invention relates generally to power generating systems and, more particularly, to condensate polisher circuits that remove contaminants from condensate in power generating systems.

BACKGROUND OF THE INVENTION

It is desirable to prevent contaminants, such as oxygen and carbon dioxide, from entering the components of power generating systems, such as steam generating systems. When the concentrations of oxygen and carbon dioxide are high enough, they become corrodents to iron and steel used in the components of the steam generating systems, including piping and steam generators. The corrosion product is iron oxide, which tends to deposit on steam generator surfaces and reduce heat transfer. Corrosion also causes wall thinning of steel structures in the steam generating systems and can result in leaks and failures. In addition to being a corrodent, carbon dioxide interferes with monitoring of the steam generating systems for more corrosive species, such as chloride. Hence, carbon dioxide is a nuisance that may require the steam generating systems to use more sophisticated monitoring equipment at significantly greater expense.

Despite attempts to prevent the leakage of contaminants into steam generating systems, during certain operating conditions of the steam generating systems, some leakage may occur. For example, contaminants may leak into a condenser of the steam generating system when the system is stopped or slowed, such as during shut-down phase of the system. Various maintenance procedures that may be performed during the system shut-down phase require that one or more of the components of the steam generating system be filled with air, i.e., so that a human may enter into the component to perform maintenance thereto.

After a system shut-down phase and prior to a system start-up phase, condensate polishers may be used to remove contaminants from the condensate e.g., dirt, salts, sodium, chloride, and carbon dioxide that may have leaked into the condenser during a system shut-down phase, which dissolved into the condensate. However, in steam generating systems wherein the temperature of the condensate is above about 60° Celsius, condensate polishers may not be effective to remove many types of contaminants from the condensate, as the effectiveness of condensate polishers at removing some contaminants is reduced at temperatures above about 60° Celsius. The reduced effectiveness is caused by a more rapid degradation of anion resin employed in condensate polishers at temperatures above about 60° Celsius as opposed to significantly slower degradation of the anion resin at temperatures below about 60° Celsius. Further, the effectiveness of condensate polishers at removing silica from condensate is reduced at temperatures above about 50° Celsius.

SUMMARY OF THE INVENTION

In accordance with one aspect of the present invention, a power generating system including a working fluid circuit is provided. The power generating system comprises a condenser system in the working fluid circuit and a condensate polisher circuit. The condenser system receives a working fluid comprising steam or a combination of water and steam and condenses at least a portion of the working fluid into a condensate. The condensate has a temperature above a predetermined upper operating temperature. The condensate polisher circuit is branched off from the working fluid circuit and receives and treats said condensate from the working fluid circuit and returns treated condensate to the working fluid circuit. The condensate polisher circuit comprises a heat exchanger that reduces the temperature of the condensate equal to or below the upper operating temperature and a condensate polisher that removes contaminants from the condensate to bring the condensate to a predetermined purity.

In accordance with another aspect of the present invention, a condensate polisher circuit is provided in a power generating system that includes a working fluid circuit and a condenser system. The condenser system receives a working fluid comprising steam or a combination of water and steam and condenses at least a portion of the working fluid into a condensate having a temperature above a predetermined upper operating temperature. The condensate polisher circuit comprises a downstream heat exchanger that reduces the temperature of an inlet flow portion of the condensate equal to or below the upper operating temperature and a condensate polisher that removes contaminants from the condensate to bring the condensate to a predetermined purity.

In accordance with yet another aspect of the present invention, a method is provided for treating condensate in a steam generating system. The steam generating system includes a working fluid circuit and a condenser system. The condenser system receives a working fluid comprising steam or a combination of water and steam and condenses at least a portion of the working fluid into the condensate having a temperature above a predetermined upper operating temperature. The condensate is passed from the working fluid circuit into a condensate polisher circuit. The condensate passes through at least one heat exchanger included in the condensate polisher circuit, the heat exchanger lowering a temperature of the condensate equal to or below the upper operating temperature. The condensate passes into a condensate polisher that treats the condensate by removing contaminants from the condensate. The treated condensate is passed from condensate polisher circuit back into the working fluid circuit.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
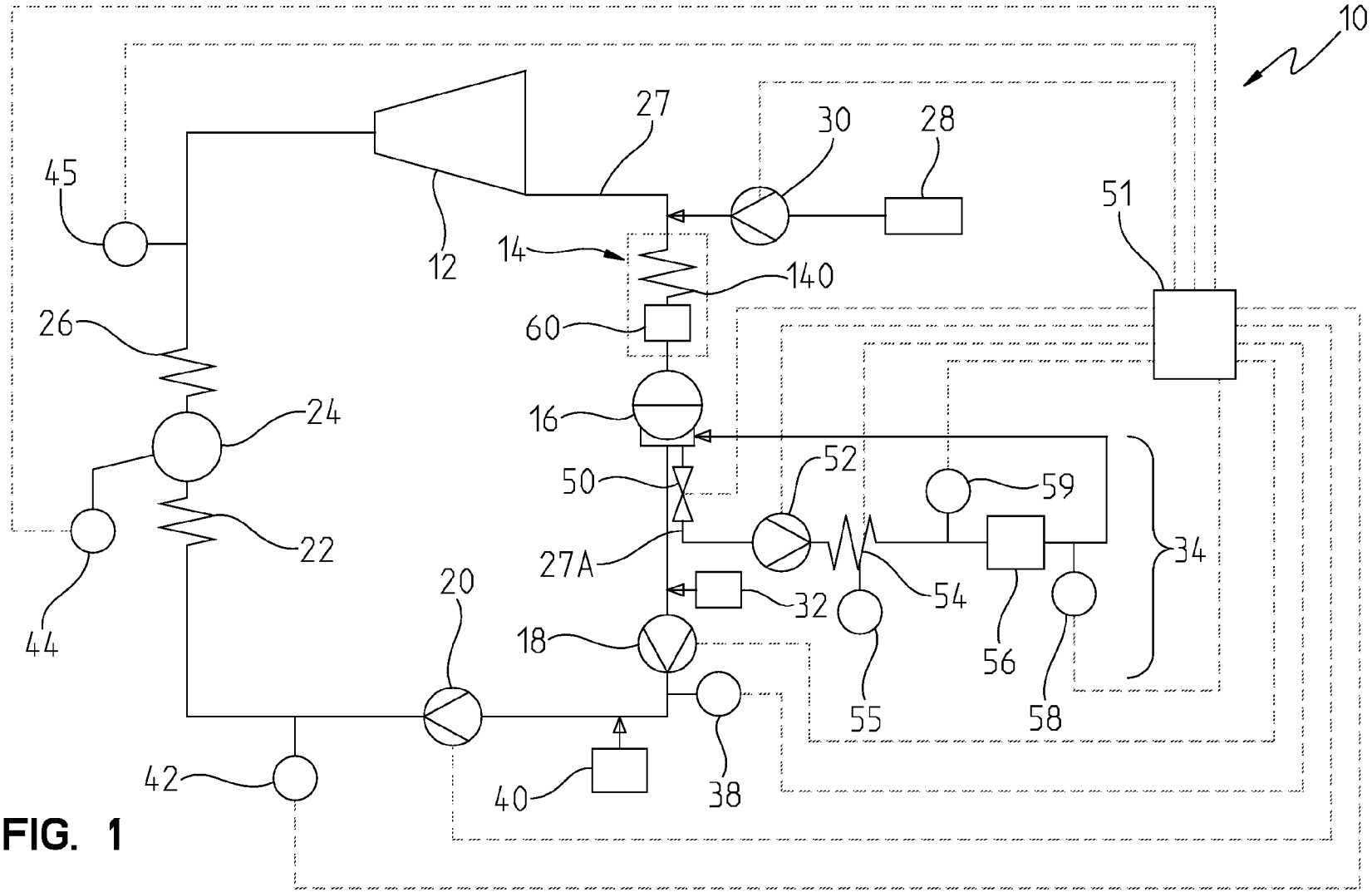
FIG. 1 is a diagrammatic illustration of a steam generating system including a condensate polisher circuit in accordance with an embodiment of the invention.

Referring to FIG. 1, an exemplary steam generating system 10 constructed in accordance with an embodiment of the present invention is schematically shown. The steam generating system 10 comprises a working fluid circuit, which includes, (moving clockwise in FIG. 1 starting from the top) a steam turbine 12, a condenser system 14 including a condenser 140 and a pressure maintenance apparatus 60, a condensate receiver tank 16, a first pump 18, a second pump 20, a condensate preheater or economizer 22, a drum 24 having an associated evaporator (not shown), and a super heater 26. The components are in fluid communication via conduits 27 that extend between adjacent components. As used herein, the term fluid may refer to any liquid, gas, or any combination thereof.

During operation, a working fluid comprising water and steam are cycled through the steam generating system 10 such that pressurized steam provided to the turbine 12 causes a rotor within the turbine 12 to rotate. The working fluid exits the turbine 12 and is combined with an amount of make-up water from a demineralized water storage tank 28 so as to compensate for any water losses that may have occurred within the steam generating system 10. The make-up water is pumped by a third pump 30 into the working fluid downstream from the turbine 12 or may be sprayed into a deaerator apparatus (not shown) associated with the condensate receiver tank 16 or into the condensate receiver tank 16. One deaerator apparatus that may be used is disclosed in U.S. patent application Ser. No. 12/366,716, entitled POWER GENERATING PLANT HAVING INERT GAS DEAERATOR AND ASSOCIATED METHODS, filed concurrently with this patent application, the entire disclosure of which is incorporated herein by reference. An example of a steam generating system incorporating such a deaerator apparatus is disclosed in U.S. patent application Ser. No. 12/366,802, entitled DEAERATOR APPARATUS IN A SUPERATMOSPHERIC CONDENSER SYSTEM, filed concurrently with this patent application, the entire disclosure of which is incorporated herein by reference.

The working fluid is then conveyed into the condenser system 14. One condenser system that may be used is disclosed in U.S. patent application Ser. No. 12/366,763, entitled CONDENSER SYSTEM, filed concurrently with this patent application, the entire disclosure of which is incorporated herein by reference. In the condenser system 14, the enthalpy of the working fluid is lowered such that at least a portion of the working fluid is substantially converted into (liquid) condensate.

The condensate, which may have a temperature of greater than about 50° Celsius, e.g., about 100° Celsius, then exits the condenser system 14 and flows into the condensate receiver tank 16. The condensate receiver tank 16 may act as a collection tank for the condensate. After exiting the condensate receiver tank 16, controlled quantities of oxygen may be provided to the condensate via an oxygen source 32 to promote a dense, protective hematite or magnetite passive layer on structure forming part of the steam generating system 10 in a process that will be apparent to those skilled in the art.

In the embodiment shown, a condensate polisher circuit 34, which may be temporarily utilized in the steam generating system 10 for treating the condensate, is branched off from the condensate receiver tank 16. It is understood that the condensate polisher circuit 34 could be branched off from other locations downstream from the condenser system 14, such as, for example, between the first pump 18 and the second pump 20. Additional details regarding the condensate polisher circuit 34 will be discussed below.

A first condensate sample point 38 is located between the first and second pumps 18, 20 where the cation conductivity, oxygen, sodium, and silica of the condensate can be measured. One or more of the cation conductivity, oxygen, sodium, and silica define the purity of the condensate. If the purity is found to be out of specification, measures can be taken to correct the problem as will be discussed below.

Ammonia ($NH_3$) may then be introduced into the condensate from a source of ammonia 40 located between the first condensate sample point 38 and the second pump 20. The ammonia may be introduced to raise the pH of the condensate, preferably to a pH of about 9. Once the ammonia is introduced into the condensate, the condensate is typically referred to as feed water, which feed water is sampled at a feed water sample point 42 and then fed into the economizer 22. At the feed water sample point 42, the specific conductivity, cation conductivity, pH, oxygen, sodium, iron, copper, and total organic carbon (TOC) of the feed water can be measured. One or more of the specific conductivity, cation conductivity, pH, oxygen, sodium, iron, copper, and total organic carbon (TOC) define the purity of the feed water. If the purity is found to be out of specification, measures can be taken to correct the problem as will be discussed below.

The feed water is then fed into the economizer 22 where the feed water is heated to a few degrees below a saturation temperature defined by the steam generator pressure. For example, a 125 barg boiler would have a saturation temperature of 328° C. and a final feedwater temperature of about 325° C.

The heated feed water is then conveyed from the economizer 22 into the drum 24 wherein the feed water is typically referred to as drum water. A drum water sample point 44 is associated with the drum 24 where the cation conductivity, pH, sodium, silica, and iron of the drum water can be measured. One or more of the cation conductivity, pH, sodium, silica, and iron define the purity of the drum water. If the purity is found to be out of specification, measures can be taken to correct the problem as will be discussed below. The drum water is cycled though the evaporator, which converts part of the drum water into steam. The mixture of steam and water rises to the top of the evaporator and into the drum 24 where the steam is separated from the water. The separated water remains in the drum and is recirculated to the evaporator and the steam passes into the super heater 26 wherein the temperature of the steam is increased to about 450-550° C.

The superheated steam is then sampled at a superheated steam sample point 45 where the cation conductivity, sodium, silica, and iron of the superheated steam are measured. One or more of the cation conductivity, sodium, silica, and iron define the purity of the superheated steam. If the purity is found to be out of specification, measures can be taken to correct the problem as will be discussed below. The superheated steam is then conveyed into the steam turbine 12. As the superheated steam passes through the turbine 12, energy is removed from the steam and the steam exits the turbine 12 where it is again conveyed into the condenser system 14 for a subsequent cycle through steam generating system 10.

During a normal operating mode of the condenser 140, its internal pressure is equal to or greater than a predefined pressure. The predefined pressure may be ambient pressure, i.e., the pressure on the outside of the condenser 140, typically 1 atmosphere (normal atmospheric pressure). During a non-normal operating mode of the condenser 140, its internal pressure is less than the predefined pressure. A non-normal operating mode of the condenser 140 may occur when the steam generating system 10 is shut down or the steam generating system 10 is operating at a reduced-load wherein a shut-down sequence has commenced but the steam generating system 10 has not completely shut-down. Hence, during a non-normal operating mode of the condenser 140, the amount of working fluid entering the condenser 140 from the conduit 27 may be reduced (i.e., during reduced-load operation) or null (i.e., during steam generating system shut down). Hence, the amount of working fluid entering the condenser 140 from the conduit 27 may not be sufficient to maintain pressure in the condenser 140 equal to or above the predefined pressure, i.e., ambient pressure.

If the pressure within the condenser 140 falls below the ambient pressure, air or other contaminants, e.g., oxygen or carbon dioxide, may leak into the condenser 140, which is undesirable. The condenser 140 and other heat transfer components in the steam generating system 10 may be partially formed from iron, which may become corroded by high concentrations of oxygen and carbon dioxide. Specifically, a corrosion product, e.g., iron oxide, tends to deposit on the surfaces of the condenser system 14 and other heat transfer components in the steam generating system 10 that are formed at least partially from iron. The iron oxide is undesirable on the surfaces of these components as it reduces heat transfer. Further, corrosion may also cause wall thinning of condenser components and other structures within the steam generating system 10, which can result in leaks and failures.

Moreover, the carbon dioxide from the air may interfere with monitoring of the steam generating system 10. For example, carbon dioxide and chloride (a highly detrimental chemical species if leaked in the steam generating system 10) are both known to cause an increase in the cation conductivity of the working fluid flowing through the steam generating system 10. As the cation conductivity is measured at one or more of the sample points 38, 42, 44, 45 the high carbon dioxide may mask any indication for chloride in the steam generating system 10, i.e., the heightened cation conductivity due to high or increased chloride cannot be noticed due to the high cation conductivity caused by the carbon dioxide. Given that chloride is a highly detrimental species to have in the steam generating system 10, such masking of the chloride is very undesirable.

The pressure maintenance apparatus 60 may be employed in the steam generating system 10 to maintain the pressure within the condenser 140 equal to or greater than the predefined pressure during normal and non-normal operating modes of the steam generating system 10. The pressure maintenance apparatus 60 substantially prevents air and other contaminants from entering the condenser 140 during normal and non-normal operating modes of the condenser 140 by maintaining the pressure within the condenser 140 equal to or above the pressure on the outside of the condenser 140. Accordingly, damage to the components of the steam generating system 10 associated with corrodents resulting from the air, and also the monitoring problems described above associated with the carbon dioxide in the air, are substantially avoided. Additional details in connection with the pressure maintenance apparatus 60 can be found in the above-referenced U.S. patent application Ser. No. 12/366,763, entitled CONDENSER SYSTEM.

As discussed above, the pressure maintenance apparatus 60 prevents air and other contaminants from entering the condenser 140 during normal and non-normal operating modes of the condenser 140 by maintaining the pressure within the condenser 140 equal to or above the pressure on the outside of the condenser 140. However, under certain circumstances, air and/or other contaminants may enter into the condenser 140 and/or other components of the steam generating system 10, which contaminants may dissolve into the condensate. For example, certain maintenance procedures may necessitate that the condenser 140 be filled with air, i.e., such that a human may enter the condenser 140 to perform the maintenance procedure(s). Filling the condenser 140 with air may cause the amount of contaminants in the condensate to become too high for preferred operation of the steam generating system 10. In which case, all or some of the contaminants must be removed from the condensate to bring the condensate to an acceptable purity such that a typical operating state of the steam generating system 10 may take place.

The typical operating state of the steam generating system 10 may be defined, for example, when the working fluid (condensate, make-up water, feed water, drum water, steam, superheated steam) comprises a predetermined purity, as measured at one or more of the sample points 38, 42, 44, 45. During the typical operating state, a valve 50, which may be located, for example, in a section of conduit 27A branched off from the condensate receiver tank 16, is closed, such that the condensate bypasses the condensate polisher circuit 34 and is pumped by the first and second pumps 18, 20 and passed through the remainder of the steam generating system 10. It is noted that, while the condensate polisher circuit 34 is shown as branched off of the condensate receiver tank 16 in FIG. 1, the condensate polisher circuit 34 may be associated with other structures associated with the condenser 140, such as, for example, the condenser 140 itself or may be branched from a location downstream from the condenser 140, e.g., between the first and second pumps 18, 20.

However, during a non-typical operating state of the steam generating system 10, which may be defined, for example, when the working fluid (condensate, make-up water, feed water, drum water, steam, superheated steam) comprises an undesirable purity, i.e., the purity is found to be out of specification, as measured at one or more of the sample points 38, 42, 44, 45, the valve 50 is opened. Additionally, the first and second pumps 18, 20 may be deactivated, depending on the measured purity of the condensate. For example, if the condensate is extremely contaminated, the first and second pumps 18, 20 may be deactivated such that the condensate is substantially prevented from passing through the first and second pumps 18, 20 and on through the remainder of the steam generating system 10. Alternatively, if the condensate comprises an undesirable purity but is not extremely contaminated, the first and second pumps 18, 20, and optionally one or more of the remaining components of the steam generating system 10, may remain activated such that a portion of the condensate passes through the first and second pumps 18, 20 and on through any active components of the steam generating system 10.

Further during the non-typical operating state of the steam generating system 10, a third pump 52 disposed in the section of conduit 27A, which may be a dedicated condensate polisher circuit pump, is activated. The third pump 52 pumps an inlet flow portion of the condensate from the working fluid circuit, i.e., from the condensate receiver tank 16, through the first valve 50, into a heat exchanger 54, into a condensate polisher 56, and back into the working fluid circuit, i.e., back into the condensate receiver tank 16. The valve 50 and the first, second, and third pumps 18, 20, 52 may be controlled, for example, by a controller 51. The controller 51 may be in communication with one or more of the sample points 38, 42, 44, 45 for receiving measurements from the one or more of the sample points 38, 42, 44, 45 and controlling the opening and closing of the valve 50 and the activation/deactivation of the first, second, and third pumps 18, 20, 52 based on the received measurements.

The temperature of the condensate, which, as noted above, may be about 100° Celsius when exiting the condenser 140 and entering into the condensate receiver tank 16 of the disclosed steam generating system 10, is reduced in the heat exchanger 54 equal to or below a predetermined upper operating temperature. The upper operating temperature is a temperature wherein the condensate polisher 56 can be effectively used to remove contaminants, e.g., sodium, chloride, carbon dioxide, etc., from the reduced-temperature condensate. For example, if sodium, chloride, and carbon dioxide are to be removed from the condensate, the upper operating temperature of the condensate may be about 60° Celsius or less.

The temperature of the condensate may further be reduced in the heat exchanger 54 equal to or below a predetermined lower operating temperature. The lower operating temperature is a temperature wherein a condensate polisher 56 can be effectively used to remove other contaminants, e.g., silica, from the further-reduced-temperature condensate. It is understood that the lower operating temperature of the condensate may vary depending on the contaminants to be removed therefrom. For example, if silica is to be removed from the condensate, the lower operating temperature of the condensate may be about 50° Celsius or less. The upper and/or lower operating temperatures may be set to bring the condensate to a predetermined purity.

It is noted that the heat exchanger 54 may use a coolant from a separate cooling source 55 to cool the condensate passing through the condensate polisher circuit 34. Or, the heat exchanger 54 may use a return flow portion of the condensate to cool the condensate passing through the condensate polisher circuit 34, the return flow portion of the condensate having already passed through the heat exchanger 54 and the condensate polisher 56 and on its way back into the condensate receiver tank 16.

The condensate polisher 56 may comprise, for example, a powdered resin polisher, a deep bed polisher, or an electrodialysis polisher, and removes contaminants from the condensate in a manner that will be apparent to those skilled in the art. Additional details in connection with powdered resin polishers and deep bed polishers can be found in commonly owned U.S. Pat. No. 6,872,308, the entire disclosure of which is hereby incorporated by reference in its entirety.

It is noted that the functionality of anion resin, which may be contained in the condensate polisher 56 for removing contaminants from the condensate, is temperature dependant. For example, at higher temperatures, anion resin may decompose, thus, reducing or losing its functionality at removing contaminants from the condensate. This factor may be used when the predetermined upper operating temperature is selected. For example, an exemplary upper limit for the anion resin to remove contaminants from the condensate may be about 60° Celsius to about 70° Celsius. At these temperatures the anion resin is capable of retaining most anions and cations (contaminants) thereon, such as sodium, chloride, carbon dioxide (as bicarbonate) and sulfate, such that these contaminants may be removed from the condensate at condensate temperatures up to about 60°-70° Celsius.

However, silica, which can be a detrimental contaminant, is not retained on the anion resin at temperatures above about 50° Celsius. Therefore, if silica is to be removed from the condensate by the condensate polisher 56, the temperature of the condensate should be brought down to or below about 50° Celsius, and preferably below about 45° Celsius. This factor may be used when the predetermined lower operating temperature is selected.

It is noted that, under certain conditions, silica is not needed to be removed from the condensate, i.e., the condensate may not include silica therein in a concentration high enough such that removal thereof is necessary. Under these conditions, the temperature of the condensate need only be lowered to the predetermined upper operating temperature, i.e., 60° Celsius to 70° Celsius, and not all the way down to the predetermined lower operating temperature, i.e., 50° Celsius, since silica is not needed to be removed. However, under other conditions, i.e., when silica is to be removed from the condensate, the temperature of the condensate should be brought all the way down to or below the predetermined lower operating temperature, i.e., 50° Celsius. It is noted that in the preferred embodiment, the condensate polisher 56 is regenerated before changing the temperature of the condensate from the predetermined lower operating temperature to the predetermined upper operating temperature, as silica retained on the anion resin may be eluted from the condensate polisher 56 at higher temperatures if the condensate polisher 56 is not regenerated.

Once the condensate exits the condensate polisher 56, the condensate is sampled at a condensate polisher circuit sample point 58 and then conveyed back into the condensate receiver tank 16. At the condensate polisher circuit sample point 58, the specific conductivity, sodium, and silica of the condensate, one or more of which defining the purity of the condensate, may be measured, for example. If any of the measured properties are found to be out of specification, appropriate measures can be taken to correct the problem, e.g., the condensate polisher 56 may be regenerated, in a procedure that will be apparent to those skilled in the art. It is noted that the condensate may be cycled through the condensate polisher circuit 34 several times until the condensate comprises a predetermined purity.

It is also noted that under certain conditions, it may be desirable to measure the purity of the working fluid while little or none of the working fluid is passing through the sample points 38, 42, 44, 45, e.g., just prior to steam generating system start-up or when the condensate comprises an extremely contaminated purity, in which case the first and second pumps 18, 20 may be deactivated. During these conditions, the valve 50 may be opened and the third pump 52 may pump condensate into the condensate polisher circuit 34. The condensate may be sampled prior to entering the condensate polisher 56 at an auxiliary condensate polisher circuit sample point 59 located between the heat exchanger 54 and the condensate polisher 56. The auxiliary condensate polisher circuit sample point 59 may measure the specific conductivity, hydrogen cation, exchanged conductivity, sodium, and silica of the condensate. If the condensate is found to have an undesirable purity, the condensate may be passed into the condensate polisher 56 where contaminates may be removed from the condensate. If the condensate is found to have a desirable purity, use of the condensate polisher circuit 34 may be discontinued.

Once the condensate reaches the predetermined purity, the third pump 52 is deactivated and the first valve 50 is closed to prevent the flow of the condensate from the condensate receiver tank 16 through the condensate polisher circuit 34. Further, if the first and second pumps 18, 20 were previously deactivated, e.g., if the steam generating system 10 is initiating a start-up phase or if the condensate was extremely contaminated, the first and second pumps 18, 20 are activated.

The condensate, which now comprises the predetermined purity, may flow through the through the remainder steam generating system 10.

It is contemplated that the condensate polisher circuit 34 could be continuously run during the typical and non-typical operating states of the steam generating system 10. However, in a preferred embodiment the condensate only passes through the condensate polisher circuit 34 during the non-typical operating state of the steam generating system 10, e.g., when the when the condensate comprises an undesirable purity, such that the condensate polisher circuit 34 only operates during the non-typical operating state of the steam generating system 10. Thus, if the condensate is found to have an undesirable purity, the condensate polisher circuit 34 can be utilized to remove contaminants from the condensate to bring the condensate to a predetermined purity.

The condensate polisher circuit 34 is advantageous in power generating systems, such as the disclosed steam generating system 10, which comprise condensate having temperatures in excess of temperatures wherein condensate polishers cannot be effectively used to remove contaminants from the condensate, e.g., temperatures of above about 60° Celsius wherein the removal of salts, sodium, chloride, and carbon dioxide is desirable, and temperatures of above about 50° Celsius wherein the removal of silica is desirable. The heat exchanger 54 is able to relatively quickly lower the temperature of the condensate to a temperature such that the condensate polisher 56 can be effectively used to remove contaminants from the condensate. Accordingly, the condensate can be cooled and brought to a predetermined purity in a generally short amount of time, as compared to allowing the condensate to cool without the use of the heat exchanger 54.

Figure 2:
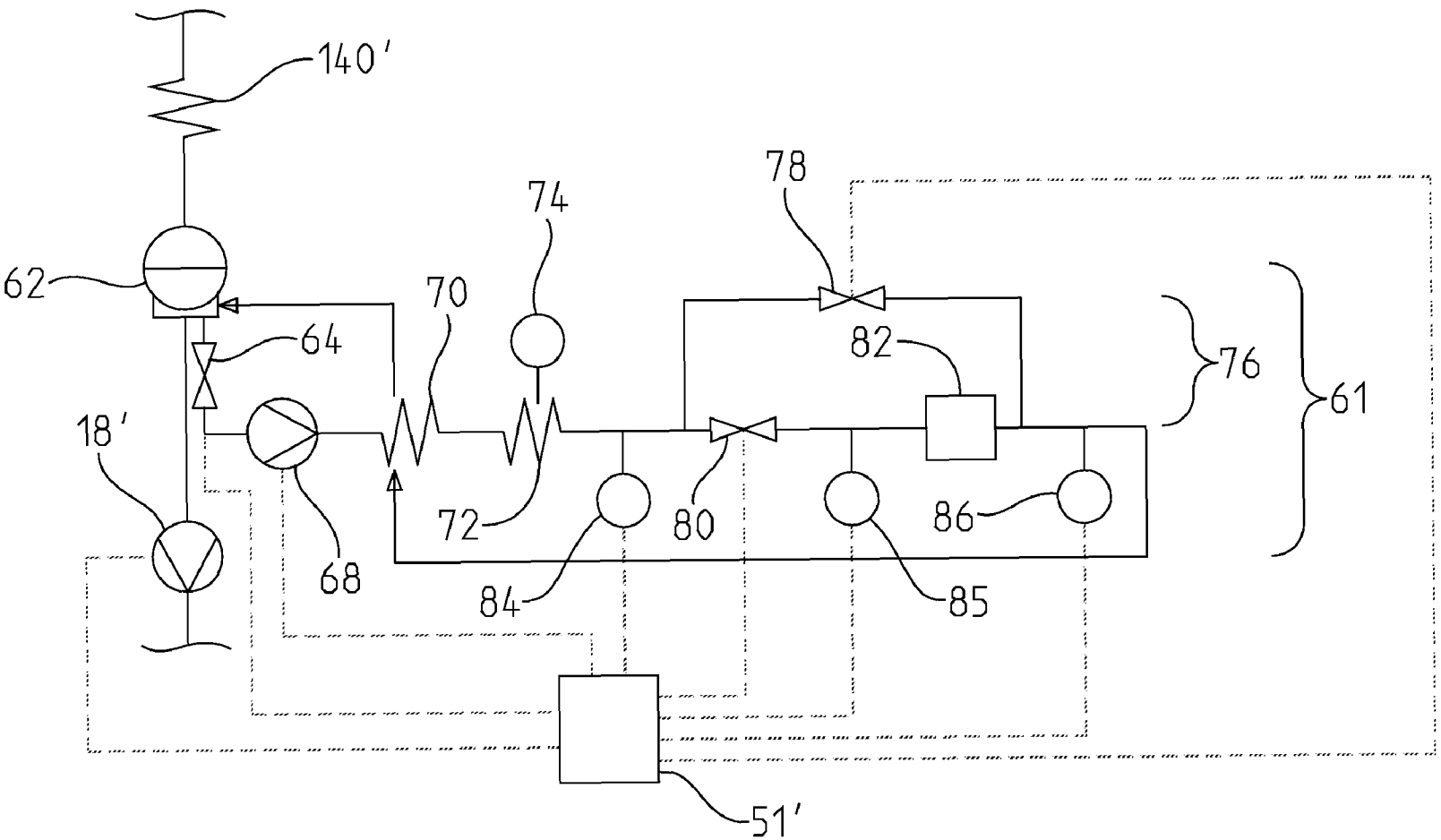
FIG. 2 is a diagrammatic illustration of a condensate polisher circuit that may be implemented in the system of FIG. 1 in accordance with another embodiment of the invention.

Referring now to FIG. 2, a condensate polisher circuit 61 according to another embodiment is shown and may be incorporated into the steam generating system 10 of FIG. 1 in place of the condensate polisher circuit 34, wherein similar structure to that described above with reference to FIG. 1 includes the same reference number followed by a prime (') symbol. It is noted that structure illustrated in FIG. 2 followed by a prime (') symbol and not specifically referred to herein with reference to FIG. 2 is substantially similar to the corresponding structure discussed above with reference to FIG. 1. The condensate polisher circuit 61 according to this embodiment may be, for example, branched off from a condensate receiver tank 62 or from other suitable locations as in the embodiment discussed above with reference to FIG. 1.

The condensate polisher circuit 61 includes a first valve 64, the opening and closing of which may be controlled by a controller 51' (the controller 51' corresponds to the controller 51 in the embodiment discussed above with reference to FIG. 1). A pump 68 is provided to pump an inlet flow portion of the condensate from a working fluid circuit, i.e., from the condensate receiver tank 62, through the condensate polisher circuit 61 and back into the working fluid circuit, i.e., back into the condensate receiver tank 62, e.g., when the condensate is found to have an undesirable purity, as discussed above with reference to FIG. 1.

In this embodiment, the condensate is pumped through the first valve 64 into an upstream heat exchanger 70. The upstream heat exchanger 70 provides initial cooling to the condensate and may, for example, use a return flow portion of the condensate to cool the condensate passing through the condensate polisher circuit 61, the return flow portion of the condensate having already passed through at least a portion of the condensate polisher circuit 61 and on its way back into the condensate receiver tank 62. Once initially cooled by the upstream heat exchanger 70, the inlet flow portion of the condensate is passed into a downstream heat exchanger 72, which provides additional cooling to the condensate. The downstream heat exchanger 72 may use a coolant, e.g., water, from a separate coolant source 74, to cool the condensate passing through the condensate polisher circuit 61.

It is noted that the cooling capacities of the upstream and downstream heat exchangers 70, 72 initially may not be sufficient to cool the condensate to a predetermined operating temperature (which may vary depending on the types of contaminants to be removed from the condensate as discussed above with reference to FIG. 1, e.g., a predefined upper or lower operating temperature) in just one pass of the condensate through the condensate polisher circuit 61. Accordingly, a valve system 76 comprising a second valve 78 and a third valve 80 may be provided to control the passage of fluid into and around a condensate polisher 82 included in the condensate polisher circuit 61. The controller 51' may cause the second valve 78 to remain open and the third valve 80 to remain closed until the temperature of the condensate, which may be measured at a temperature sample point 84, reaches or falls below the desired upper or lower operating temperature. Until the condensate reaches the desired upper or lower operating temperature, the condensate polisher 82 is bypassed, in which case the condensate passes back into the condensate receiver tank 62 to be cooled further in another pass through the condensate polisher circuit 61.

Upon the temperature of the condensate reaching the desired upper or lower operating temperature, the controller 51' may cause the second valve 78 to close and the third valve 80 to open. Thus, upon exiting the downstream heat exchanger 72, the (now adequately cooled) condensate is passed into the condensate polisher 82 wherein contaminants are removed from the condensate as discussed above. Continued passes through the condensate polisher circuit 61 may be implemented until the condensate comprises a predetermined purity, as measured at an auxiliary condensate polisher circuit sample point 85, as discussed above with reference to FIG. 1. A condensate polisher circuit sample point 86 can be used to determine that the condensate polisher 82 is operating properly as discussed above with reference to FIG. 1.

It is noted that, once the return flow portion of the condensate has passed through both the upstream and downstream heat exchangers 70, 72, its temperature is less than it was upon initially entering the upstream heat exchanger 70 and initiating its pass through the condensate polisher circuit 61, i.e., as a result of being cooled by the upstream and downstream heat exchangers 70, 72. Thus, in a preferred embodiment, the return flow portion of the condensate, which is passing out of the condensate polisher 82 (or through the second valve 78 if the condensate polisher 82 is being bypassed), may be used by the upstream heat exchanger 70 to cool the inlet flow portion of the condensate that is initiating its pass through the condensate polisher circuit 61. This configuration increases the rate of cooling of the inlet flow portion of the condensate because of the lower temperature of the coolant provided to the upstream heat exchanger 70, i.e., the cooled return flow portion of the condensate.

This configuration, while increasing a rate of cooling of the inlet flow portion of the condensate to the desired upper or lower operating temperature for passage through the condensate polisher 82, also effects an increase in the temperature of the return flow portion of the condensate as it passes through the upstream heat exchanger 70 to the condensate receiver tank 62, i.e., the heat removed from the inlet flow portion of the condensate being cooled in the upstream heat exchanger 70 is absorbed by the return flow portion of the condensate being used as a coolant in the upstream heat exchanger 70, thus increasing the temperature of the return flow portion of the condensate, which has already passed through at least a portion of the condensate polisher circuit 61 and is passing back into the condensate receiver tank 62. Thus, the amount of heat energy required to increase the temperature of the return flow portion of the condensate returned to the condensate receiver tank 62 for use in a steam generating system (not shown in this embodiment) is reduced, thereby increasing an efficiency of the steam generating system.

Figure 3:
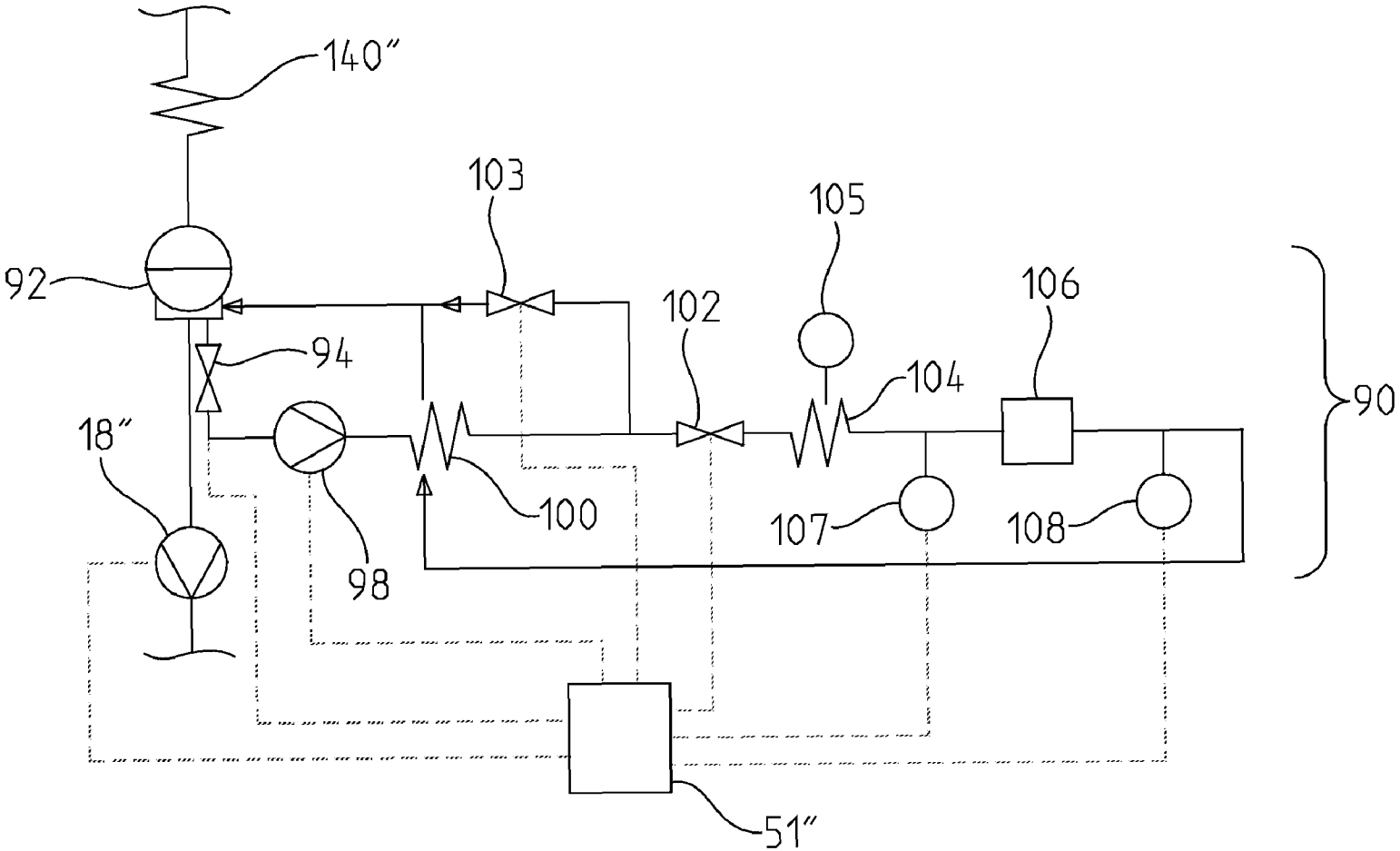
FIG. 3 is a diagrammatic illustration of a condensate polisher circuit that may be implemented in the system of FIG. 1 in accordance with yet another embodiment of the invention.

Referring now to FIG. 3, a condensate polisher circuit 90 according to another embodiment is shown and may be incorporated into the system of FIG. 1 in place of the condensate polisher circuit 34, wherein similar structure to that described above with reference to FIG. 1 includes the same reference number followed by a double prime (") symbol. It is noted that structure illustrated in FIG. 3 followed by a double prime (") symbol and not specifically referred to herein with reference to FIG. 3 is substantially similar to the corresponding structure discussed above with reference to FIG. 1. The condensate polisher circuit 90 according to this embodiment may be, for example, branched off from a condensate receiver tank 92 or from other suitable locations as in the embodiment discussed above with reference to FIG. 1.

The condensate polisher circuit 90 includes a first valve 94, the opening and closing of which may be controlled by a controller 51" (the controller 51" corresponds to the controller 51 in the embodiment discussed above with reference to FIG. 1). A pump 98 is provided to pump an inlet flow portion of the condensate from a working fluid circuit, i.e., from the condensate receiver tank 92 through the condensate polisher circuit 90 and back into the working fluid circuit, i.e., back into the condensate receiver tank 92, e.g., when the condensate is found to have an undesirable purity, as discussed above for FIG. 1.

In this embodiment, the condensate is pumped through the first valve 94 into an upstream heat exchanger 100. The upstream heat exchanger 100 provides initial cooling to the condensate and may, use a return flow portion of the condensate to cool the condensate passing through the condensate polisher circuit 90, the return flow portion of the condensate having already passed through at least a portion of the condensate polisher circuit 90 and on its way back into the condensate receiver tank 92. Once initially cooled by the upstream heat exchanger 100, the inlet flow portion of the condensate is passed through a first variable position valve 102 and into a downstream heat exchanger 104, which provides additional cooling to the condensate. The downstream heat exchanger 104 may use a coolant, e.g., water, from a separate coolant source 105 to cool the condensate passing through the condensate polisher circuit 61.

The first variable position valve 102 may be adjusted by the controller 51" such that only a percentage of the condensate from the upstream heat exchanger 100 is permitted to pass through the first variable position valve 102 into the downstream heat exchanger 104. The percentage of the condensate from the upstream heat exchanger 100 that is permitted to pass through the first variable position valve 102 into the downstream heat exchanger 104 may be selected, for example, based on a cooling capacity of the downstream heat exchanger 104. The remaining percentage of the condensate, i.e., the percentage that does not pass through the first variable position valve 102, passes through a second variable position valve 103, which may be a one-way or check valve, and back into the condensate receiver tank 92. The first and second variable position valves 102, 103 may be controlled with reference to each other to maintain a desired pressure and flow rate through the condensate polisher circuit 90.

As an example, the downstream heat exchanger 104 may be capable of cooling 50 gallons of condensate per minute from 100° Celsius (a typical temperature of the condensate as it initially exits the condensate receiver tank 92 and passes into the condensate polisher circuit 90 for the first time) to 50° Celsius (a predetermined lower operating temperature according to this exemplary embodiment). Following this example, when the temperature of the condensate exiting the upstream heat exchanger 100 is about 100° Celsius, the first variable position valve 102 may be positioned so as to allow about 50 gallons of condensate per minute therethrough into the downstream heat exchanger 104. Thus, since the downstream heat exchanger 104 can accommodate cooling 50 gallons of condensate per minute from 100° Celsius to 50° Celsius, substantially all of the condensate permitted to flow into the downstream heat exchanger 104 can be cooled to the lower operating temperature. The second variable position valve 103 is positioned so as to allow the remainder of the condensate (any condensate in excess of 50 gallons per minute) to flow therethrough and back into the condensate receiver tank 92.

Once the percentage of the condensate that passes into the downstream heat exchanger 104 is cooled to a predetermined operating temperature (which may vary depending on the types of contaminants to be removed from the condensate as discussed above with reference to FIG. 1, e.g., a predefined upper or lower operating temperature) in the downstream heat exchanger 104, the (now adequately cooled) condensate is passed into a condensate polisher 106 wherein contaminants are removed from the condensate as discussed above with reference to FIG. 1. Continued passes through the condensate polisher circuit 90 may be implemented until the condensate comprises a predetermined purity, as measured at an auxiliary condensate polisher circuit sample point 107, as discussed above with reference to FIG. 1. A condensate polisher circuit sample point 108 can be used to determine that the condensate polisher 106 is operating properly as discussed above with reference to FIG. 1.

It is noted that, once the return flow portion of the condensate has passed through one or both of the upstream and downstream heat exchangers 100, 104, its temperature is less than it was upon initially entering the upstream heat exchanger 100 and initiating its pass through the condensate polisher circuit 90. Thus, in a preferred embodiment, the return flow portion of the condensate, which is passing out of the condensate polisher 106, may be used by the upstream heat exchanger 100 to cool the inlet flow portion of the condensate that is initiating its pass through the condensate polisher circuit 90. This configuration increases the rate of cooling of the inlet flow portion of the condensate because of the lower temperature of the coolant provided to the upstream heat exchanger 100, i.e., the return flow portion of the condensate.

It is also noted that the increased rate of cooling provided by the return flow portion of the condensate to the inlet flow portion of the condensate provides additional advantages in the condensate polisher circuit 90. For example, the temperature of the condensate exiting the upstream heat exchanger 100 and headed for the downstream heat exchanger 104 may be lower for each subsequent pass through the condensate polisher circuit 90 than it was during a previous pass through the condensate polisher circuit 90. Since the downstream heat exchanger 104 is not required to lower the temperature as much to reach the desired upper or lower operating temperature, the downstream heat exchanger 104 is able to accommodate and reduce the temperature of a higher volume of condensate down to the desired upper or lower operating temperature. Following the above example, the downstream heat exchanger 104 may be capable of cooling 60 gallons of condensate per minute from 60° Celsius (an exemplary temperature of the condensate as it exits the condensate receiver tank 92 and enters the condensate polisher circuit 90 for a subsequent pass therethrough) to 50° Celsius (the lower operating temperature according to this exemplary embodiment).

In a given steam generating system, a point may be reached where the downstream heat exchanger 104 can accommodate and reduce the temperature of the full portion of the condensate exiting the upstream heat exchanger 100 down to the desired upper or lower operating temperature. In this case, the first variable position valve 102 may be fully opened and the second variable position valve 103 may be fully closed, such that all of the condensate from the upstream heat exchanger 100 will flow through the first variable position valve 102 into the downstream heat exchanger 104.

The configuration according to this embodiment, while increasing a rate of cooling of the inlet flow portion of the condensate to the desired upper or lower operating temperature for passage through the condensate polisher 106, also effects an increase in the temperature of the return flow portion of the condensate that has already passed through the condensate polisher 106, i.e., the heat removed from the inlet flow portion of the condensate being cooled in the upstream heat exchanger 100 is absorbed by the return flow portion of the condensate being used as a coolant in the upstream heat exchanger 100, thus increasing the temperature of the return flow portion of the condensate, which has already passed through the condensate polisher 106 and is passing back into the condensate receiver tank 92. Thus, the amount of heat energy required to increase the temperature of the return flow portion of the condensate returned to the condensate receiver tank 92 for use in a steam generating system (not shown in this embodiment) is reduced, thereby increasing an efficiency of the steam generating system.

It is noted that the temperature of the return flow portion of the condensate as it flows back into the condensate receiver tank 92 according to this embodiment may be less than as in the embodiment described above with reference to FIG. 2. Additionally, it is noted that the condensate polisher circuit 90 according to this embodiment is optimized to polish as much condensate as possible, as early as possible. It is further noted that the components of the condensate polisher circuits 34, 60, 90 described above with reference to FIGS. 1-3 may be combined to produce other embodiments of the invention. For example, the valve system 76 of FIG. 2 may be implemented in the condensate polisher circuit 90 of FIG. 3 such that a bypass of the condensate polisher 106 may be effected.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A power generating system including a working fluid circuit comprising:

a condenser system in the working fluid circuit that receives a working fluid comprising steam or a combination of water and steam and condenses at least a portion of said working fluid into a condensate, said condensate having a temperature above a predetermined upper operating temperature;

a condensate polisher circuit branched off from the working fluid circuit that receives and treats said condensate from the working fluid circuit and returns treated condensate to the working fluid circuit, said condensate polisher circuit comprising:

a valve that controls a passage of said condensate into said condensate polisher circuit;

a controller that controls an opening and a closing of said valve based on measurements received from at least one sample point;

a heat exchanger that reduces said temperature of said condensate equal to or below said upper operating temperature; and a condensate polisher that removes contaminants from said condensate to bring said condensate to a predetermined purity.

2. The power generating system as set out in claim 1, wherein a pressure within a condenser of said condenser system is equal to or greater an ambient pressure during a normal operating mode of the condenser.

3. The power generating system as set out in claim 1, further comprising a condensate receiver tank for receiving said condensate from said condenser system.

4. The power generating system as set out in claim 3, wherein said condensate polisher circuit is branched off of said condensate receiver tank, and wherein said condensate is passed into said condensate receiver tank after contaminants are removed from said condensate in said condensate polisher.

5. The power generating system as set out in claim 1, further comprising a pump that pumps said condensate through said condensate polisher circuit, said controller activates and deactivates said pump based on said measurements received from said at least one sample point.

6. The power generating system as set out in claim 1, wherein said upper operating temperature is about 60° Celsius and wherein said contaminants comprise at least one of sodium, chloride, and carbon dioxide.

7. The power generating system as set out in claim 1, wherein said heat exchanger reduces said temperature of said condensate equal to or below a predetermined lower operating temperature, said lower operating temperature being about 50° Celsius, and wherein said contaminants comprise at least silica.

8. The power generating system as set out in claim 1, wherein a return flow portion of said condensate that has been cooled by said heat exchanger is used to cool an inlet flow portion of said condensate in said heat exchanger.

9. A condensate polisher circuit in a power generating system that includes a working fluid circuit having a condenser system, the condenser system receiving a working fluid comprising steam or a combination of water and steam and condensing at least a portion of the working fluid into a condensate having a temperature above a predetermined upper operating temperature, the condensate polisher circuit comprising:

an upstream heat exchanger;

a downstream heat exchanger disposed downstream from said upstream heat exchanger, said upstream and downstream heat exchangers cooperating to reduce the temperature of an inlet flow portion of the condensate equal to or below the upper operating temperature; and a condensate polisher that removes contaminants from the condensate to bring the condensate to a predetermined purity.

10. The condensate polisher circuit as set out in claim 9, wherein said inlet flow portion of the condensate in said upstream heat exchanger is cooled by a return flow portion of the condensate downstream from said downstream heat exchanger.

11. The condensate polisher circuit as set out in claim 10, wherein said return flow portion of the condensate comprises condensate that has been cooled by at least one of said upstream and downstream heat exchangers and is used to cool said inlet flow portion of the condensate in said upstream heat exchanger.

12. The condensate polisher circuit as set out in claim 9, further comprising a valve that controls a passage of the condensate into said downstream heat exchanger, a portion of the condensate permitted to flow through said valve and into said downstream heat exchanger based on a cooling capacity of said downstream heat exchanger and a temperature of said inlet flow portion of the condensate.

13. The condensate polisher circuit as set out in claim 9, further comprising a first valve that controls a passage of the condensate into said condensate polisher and a second valve that controls a passage of the condensate though a bypass of said condensate polisher, wherein a controller controls opening and closing of said first and second valves based on the temperature of the condensate.

14. The condensate polisher circuit as set out in claim 13, wherein said controller causes said first valve to close and said second valve to open when the temperature of the condensate is greater than the upper operating temperature and said controller causes said first valve to open and said second valve to close when the temperature of the condensate is equal to or less than the upper operating temperature.

15. A method for treating condensate in a steam generating system including a working fluid circuit and a condenser system, the condenser system receiving a working fluid comprising steam or a combination of water and steam and condensing at least a portion of the working fluid into the condensate having a temperature above a predetermined upper operating temperature, the method comprising:

passing the condensate from the working fluid circuit into a condensate polisher circuit comprising:

passing the condensate through at least one heat exchanger included in the condensate polisher circuit, the at least one heat exchanger lowering a temperature of the condensate equal to or below the upper operating temperature;

passing the condensate into a condensate polisher, the condensate polisher treating the condensate comprising removing contaminants from the condensate; and using a return flow portion of the condensate to cool an inlet flow portion of condensate, the return flow portion of the condensate exiting the condensate polisher on its way back into the working fluid circuit, and the inlet flow portion of the condensate entering the at least one heat exchanger from the working fluid circuit; and passing the treated condensate from condensate polisher circuit back into the working fluid circuit.

16. The method according to claim 15, wherein passing the condensate from the working fluid circuit into a condensate polisher circuit comprises passing the condensate through a condensate polisher circuit only during a non-typical operating state of the steam generating system when the condensate comprises an undesirable purity, and by-passing the condensate polisher circuit during operation of the steam generating system when the condensate conforms to a predetermined purity.

17. The method according to claim 15, wherein the return flow portion of the condensate exits the condensate polisher on its way back into a condensate receiver tank included in the working fluid circuit, and the inlet flow portion of the condensate enters the at least one heat exchanger from the condensate receiver tank.

18. The condensate polisher circuit as set out in claim 14, wherein the condensate passing through the bypass of said condensate polisher when said second valve is open is subsequently reintroduced into the condensate polisher circuit for further cooling by at least one of said upstream and downstream heat exchangers.

19. The method according to claim 15, wherein passing the condensate through at least one heat exchanger comprises passing the condensate through an upstream heat exchanger and a downstream heat exchanger, the upstream and downstream heat exchangers cooperating to reduce the temperature of the inlet flow portion of the condensate equal to or below the upper operating temperature.

20. The method according to claim 15, wherein passing the condensate through at least one heat exchanger comprises:

passing the condensate through the at least one heat exchanger, and, if the temperature of the condensate is not lowered by the at least one heat exchanger equal to or below the upper operating temperature, causing the condensate to bypass the condensate polisher; and repeatedly passing the condensate through the at least one heat exchanger and causing the condensate to bypass the condensate polisher until the temperature of the condensate is lowered equal to or below the upper operating temperature, and then passing the condensate into the condensate polisher.

* * * * *